United States Patent [19]

Tsunekawa et al.

[11] 4,162,426

[45] Jul. 24, 1979

[54] ZONE RESPONSIVE, LIGHT-SENSING CIRCUIT FOR CONTROLLING FLASH PHOTOGRAPHING

[75] Inventors: Tokuichi Tsunekawa, Yokohama; Zenzo Nakamura, Urawa; Osamu Okubo; Takashi Uchiyama, both of Yokohama, all of Japan

[73] Assignee: Canon Kabushiki Kaisha, Tokyo, Japan

[21] Appl. No.: 862,672

[22] Filed: Dec. 21, 1977

Related U.S. Application Data

[63] Continuation of Ser. No. 615,363, Sep. 22, 1975, abandoned.

[30] Foreign Application Priority Data

Sep. 25, 1974 [JP] Japan ..... 49-110101

[51] Int. Cl.[2] ..... H05B 41/32

[52] U.S. Cl. ..... 315/151; 250/214 P; 315/155; 315/241 P; 354/31; 354/33

[58] Field of Search ..... 315/151, 155, 158, 159, 315/241 P; 250/209, 214 P; 356/222; 354/31-33, 139, 145, 149

[56] References Cited

U.S. PATENT DOCUMENTS

| | | | |
|---|---|---|---|
| 3,545,350 | 12/1970 | Gross | 250/209 X |
| 3,563,143 | 2/1971 | Peterson | 356/222 X |
| 3,568,582 | 3/1971 | Uchida et al. | 315/151 X |
| 3,714,442 | 1/1973 | Frank | 250/214 P |
| 3,749,921 | 7/1973 | Vital et al. | 250/214 P |
| 3,836,920 | 9/1974 | Uchiyama et al. | 354/149 X |

*Primary Examiner*—Eugene R. La Roche

*Attorney, Agent, or Firm*—Toren, McGeady and Stanger

[57] ABSTRACT

The present invention relates to a light-sensing circuit used in a so-called light regulating type flash device to automatically control the amount of flash emitted. In the present invention, a flash photographing with an appropriate exposure is done, securing such flash amount as providing appropriate exposure always regardless of the position of an object in a photographing frame. This is done by making light-sensing for each of different zones independently using a plural number of light-sensing circuits for stopping the flashing by the output of the one light-sensing circuit reaching a prescribed level of output from the different light-sensing circuits.

8 Claims, 12 Drawing Figures

ZONE RESPONSIVE, LIGHT-SENSING CIRCUIT FOR CONTROLLING FLASH PHOTOGRAPHING

This is a continuation of application Ser. No. 615,363, filed Sept. 22, 1975, now abandoned.

BACKGROUND OF THE INVENTION

1. Field of the Invention

The present invention relates to a flash device used in a camera, and to be more exact relates to a light-sensing device of a light regulating type flash device of such type that the flash light irradiated by a flash device and reflected from an object is received by light receiving means provided at the flash device and the flashing time is controlled by the amount of said reflected light.

2. Description of the Prior Art

In a conventional flash device of light regulating type, a light receiving means is provided at a flash device to receive the light reflected from an object, but said light receiving means is provided at a position receiving the light reflected from the center line of the object zone being photographed by a photographing lens of a camera. That is, since photographing is made ordinarily by making a picture composition that an object to be photographed with flash is positioned on the center line of a photographing lens, a light receiving lens is provided which receives light reflected from the center line of the photographing lens. However, with a conventional light sensing system, the scope in which proper exposure can be always obtained is limited to the zone of the angle of light receiving by the light receiving means, that is, a very narrow zone on the center line of the photographing lens. Thus, when an object is placed at a position which deviates from the center line of the photographing lens, proper exposure can not be obtained. Thus, there have been such shortcomings that a picture composition has to be made which places a main object at the center of a photographing picture frame at the time of flash photographing, or improper exposure will result for objects in a circumferential zone when objects exist over the entire photographing picture frame.

SUMMARY OF THE PRESENT INVENTION

An object of the present invention is to provide a light sensing circuit for a flash device which is made to obtain proper exposure for an object regardless of the position of an object against the photographing picture frame.

Another object of the present invention is to provide light sensing circuits for a flash device in which a plural number of light sensing circuits to sense the light from flashing device being reflected from different photographing zones are provided, and flashing is stopped by the output of the light sensing device which first secures a prescribed level of output out of the light sensing circuits.

Further other objects of the present invention will be made apparent from the detailed description of the invention to be made together with explanation of drawings.

BRIEF DESCRIPTION OF THE DRAWINGS

FIG. 3(*b*) is a circuit diagram to show an example of a boosting circuit in FIG. 3(*a*).

FIG. 3(*c*) is a circuit diagram to show an example of a trigger circuit in FIG. 3(*a*).

FIG. 5(*b*) is a schematic diagram showing the light sensing zones by FIG. 5(*a*).

FIG. 5(*c*) is a schematic diagram to show examples of various light sensing zones of the light sensing zone scope by the light sensing circuits of the present invention.

DESCRIPTION OF THE EMBODIMENTS OF THE INVENTION

Figure 1:
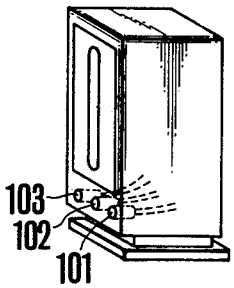
FIG. 1 is a set-up diagram to show an arrangement of light receiving means in a light sensing circuit for a flash device according to the present invention.
Figure 1:
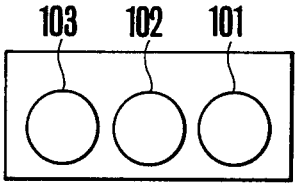
Figure 2:
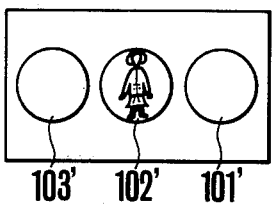
FIG. 2(*a*), (*b*), (*c*) are schematic diagrams to show light sensing zones corresponding to such photographing zone each of which passes through a photographing lens.
Figure 2:
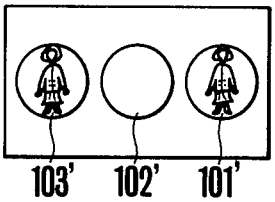
Figure 2:
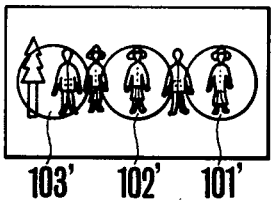
Figure 3:
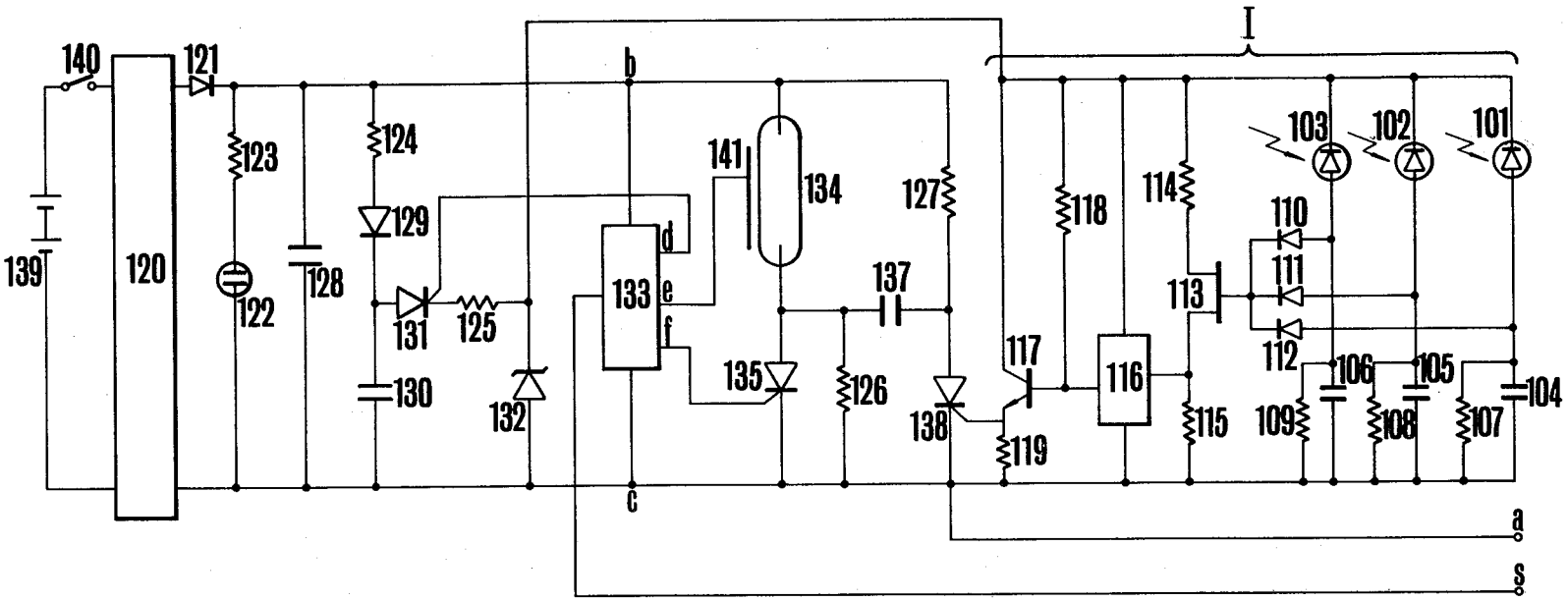
FIG. 3(*a*) is a circuit diagram to show an example of a flash device circuit having light sensing circuits for a flash device according to the present invention.
Figure 3:
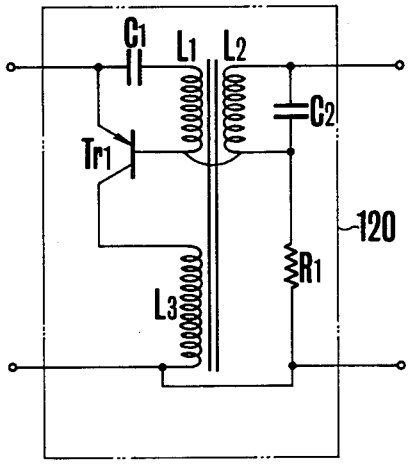
Figure 3:
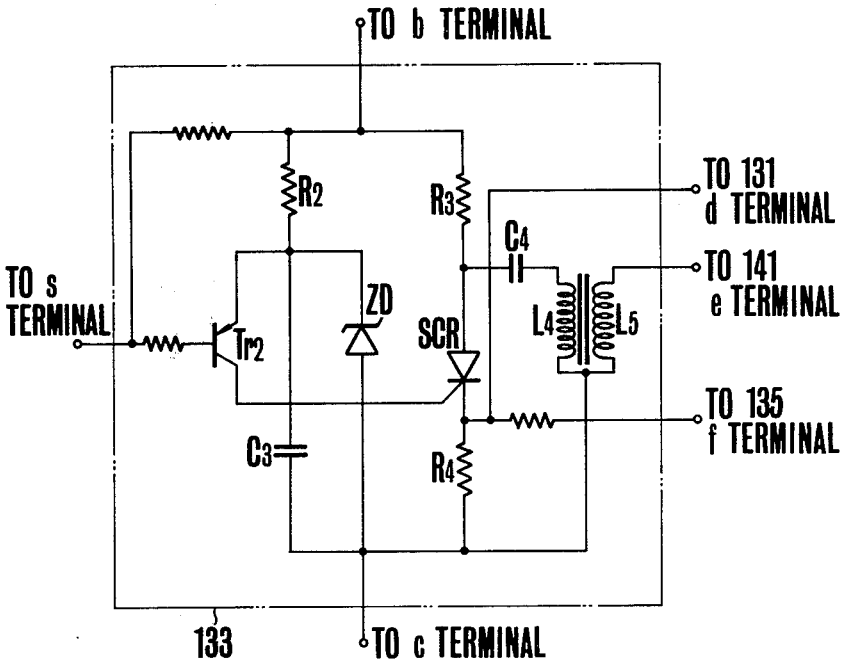

FIG. 1 is a set-up diagram to show an arrangement of light receiving means in light sensing circuits of a flash device according to the present invention, wherein (a) shows a flash device and (b) shows a light sensing part of the flash device. In FIG. 1, what is shown as 101 to 103 are light receiving means such as photo-diodes, etc. FIG. 2 is an object image arrangement diagram to show a picture frame for an object image which passes through a photographing lens. FIG. 3(*a*) is a circuit diagram to show an example of a flash device circuit having light sensing circuits of a flash device according to the present invention. In FIG. 3(*a*), what is shown as 139 is a power source, 140 is a power source switch, 120 is a conventionally known boosting circuit to boost power source voltage, and consists of, as shown in FIG. 3(*b*) a transistor $Tr_1$ having its emitter side connected with one pole of the power source and its collector side connected with the other pole of the power source through a coil $L_3$, a coil $L_1$ and capacitor $C_1$ being connected in series between the base and emitter of the transistor $Tr_1$, a secondary coil $L_2$ against the coil $L_1$, a capacitor $C_2$ being connected in series to the coil $L_2$, and a resistance $R_1$ being connected in series to the capacitor $C_2$. 121 is a diode to rectify the output of the boosting circuit 120. 123 is a resistance and 122 is a neon tube which becomes ON when a main capacitor 128 for accumulating flashing energy is charged to a prescribed electric potential to indicate completion of charging. 124 is a resistance, 129 is a diode and 130 is a capacitor, three of which are being connected in series. 131 is a thyristor, 125 is a resistance connected in series to the thyristor 131 and 132 is a zener diode, three of which are so connected with both ends of the capacitor 130 as constituting a discharge path when the thyristor 131 becomes ON, and the capacitor 130, thyristor 131, resistance 125 and zener diode 132 constitutes a power source circuit for a light sensing circuit I to be described below. 134 is a flash discharge tube and 135 is a thyristor being connected in series to the discharge tube, wherein the two components constitute a discharge path for the main capacitor 128. 141 is a trigger electrode to trigger the discharge tube 134, and 133 is a trigger circuit to impress the output on the above mentioned thyristor 131, the gate of 135 and the trigger electrode 141 by an action of conventionally known type of synchronizing switch when short circuiting takes place between the contacts a, c. And the trigger circuit 133 consists of an output circuit comprising a resistance $R_2$, a capacitor $C_3$, being connected in series between b terminal and c terminal, a zener diode ZD being connected in parallel with the capacitor $C_3$, a transistor $Tr_2$ having its emitter side connected with one terminal of the capacitor and having its base connected with the above mentioned terminal S further having its collector connected with the gate of the thyristor SCR, and resistors $R_3$, $R_4$ and a thyristor SCR, and a conventionally known discharge tube trigger circuit comprising a trigger capacitor $C_4$ connected to a connecting point between the resistance $R_3$ and the thyrister SCR and coils $L_3$, $L_5$, as shown by FIG. 3(*c*), wherein output signal is generated at each of terminals d, e, f when short-circuiting takes place between the above mentioned s terminal and a terminal. I is a light sensing circuit, in which 101 to 103 are light receiving means to sense the light in the different zones to be photographed, and 104 to 106 are capacitors connected to the light receiving means respectively, and an integration circuit is formed by the light receiving means and the capacitor. 107 to 109 is a resistance for discharging, 110 to 112 are separation diodes to input the maximum output out of the above mentioned integration circuit into FET 113. 114, 115 are resistances. 116 is a conventionally known switching circuit consisting of a Schmitt circuit, etc., which functions when the FET becomes ON to place the transistor 117 ON. 118 is a resistance connected between the base and collector of the transistor 117. 119 is a resistance connected to the emitter of the transistor 117. 137 is a commutation capacitor. 126, 127 are resistors connected in series to the capacitor 137. 138 is a thyristor having its anode connected with the resistance 127 and the capacitor 137, and having its gate connected with the emitter of the above mentioned transistor 117.

In operation, when the power source switch 140 is turned ON, the voltage of the power source 139 is boosted by the boosting circuit 120, and the main capacitor 128, the commutation capacitor 137, the capacitor 130 and the capacitors $C_3$, $C_4$ shown in FIG. 3(*c*) are charged. When the main capacitor is charged to a prescribed potential, the neon tube 122 turns ON and is lighted to indicate completion of the charging. Next, pressing down a shutter button of a camera, which is not shown in the drawing, causes a leading shutter screen to run, and a synchronizing switch not shown in the drawing is turned ON by conventionally known means as the leading screen runs. The contacts a and s are now short-circuited, and the base potential of the transistor $Tr_2$ of FIG. 3(*c*) is lowered. The transistor $Tr_2$ turns ON, and the electric charge of the capacitor $C_3$ is discharged through the transistor $Tr_2$, then the gate potential of the thyristor SCR goes high and the thyristor SCR turns ON. The ON thyristor discharges the electric charge accumulated at the capacitor $C_4$ and generates an induced voltage at the coil $L_5$. The discharge tube is now triggered by the trigger electrode 141. At this time, since the electric potential at the terminals d, f shown in FIG. 3(*c*) goes high and the gate potential of the thyristors 131, 135 goes high, these thyristors also turn on and the discharge tube 134 emits a flash. At the same time the electric charge accumulated at the capacitor 130 is discharged through the thyristor 131, the resistance 125, and the zener diode 132. Hence a prescribed voltage level is generated between the terminals of the zener diode 132 for a predetermined length of time. This voltage appears across the light sensing circuit I and activates the light sensing circuit.

As the discharge tube 134 emits a flash the light irradiated on an object and reflected therefrom is received by the light receiving means 101 to 103 and a current corresponding to the output of each light receiving means flows to the capacitors 104 to 106 respectively to charge the capacitors 104 to 106. The length of time required for the capacitors 104 to 106 to be charged to a predetermined level of potential will be determined by the amount of light reflected from an object and received by the light receiving elements 101 to 103. When an object is located at the position shown by FIG. 2(*a*) against a photographing lens, the amount of light reflected from an object at the zone 102 and received by the light receiving element 102 will become the largest. Therefore the capacitor 105 will be the first to charge to the predetermined level of potential. When objects are located as shown in FIG. 2(*b*) against the photographing lens, the amount of light received by the light receiving means 101, 103 which are provided for receiving the light reflected from the zones 101', 103' positioned to the left and the right of the center line of the photographing lens will be greater than that received by the light receiving means 102. When the distance from objects located at the zones 101', 103' to the camera is same, both light receiving means 101, 103 receive the same amount of light, therefore both the capacitors 106, 104 charge to the prescribed level of potential within the same length of time.

Also if the distance from the photographing lens to object is same when objects are located as shown in FIG. 2C against the photographing lens, the light receiving means 101 to 103 are to receive the same amount of light. Therefore, the capacitors 104 to 106 are to be charged to a prescribed level of potential within the same length of time. As these capacitors 104 to 106 are charged to a prescribed level of potential, voltage is impressed on the FET 113 through the diodes 110 to 112 and the output by the FET reaches a prescribed value and the switching circuit 116 is reversed. This causes the voltage between the base and the emitter of the transistor 117 to be such as to turn on the transistor 117 thereby placing the thyristor 138 in an ON state. Therefore, the electric charge of the commutation capacitor 137 is impressed on the thyristor 135 as inverse voltage through the thyristor 138 and the resistance 126 and the thyristor 135 is placed in OFF state so that the flash of the discharge tube is stopped.

In the above mentioned set-up, regardless of the photographing zones at which an object or objects are located in a photographing picture frame, the light reflected from each photographing zone is received by different light receiving elements. Hence the amount of flash light can be determined by the light reflected from an object or objects regardless of the position of the object or objects in the photographing picture frame. A proper exposure can always be obtained.

Figure 4:
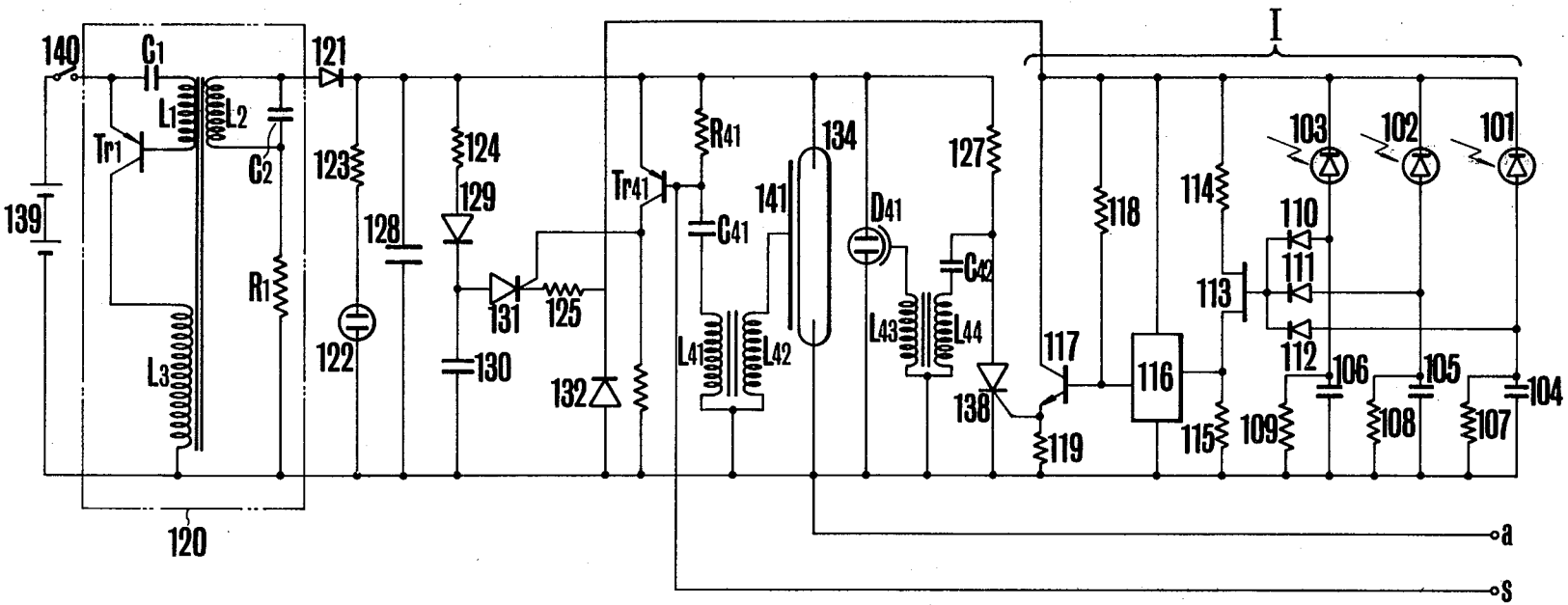
FIG. 4 is a circuit diagram to show another example of a flash device circuit having light sensing circuits for a flash device according to the present invention.

FIG. 4 is a circuit diagram to show another example of the light sensing circuit of a flash device according to the present invention, whereby each circuit element having the same set up and same function as those in the example shown in FIG. 3 is shown with the same reference number or mark, but FIG. 4 is different from FIG. 3 in that the trigger circuit 133 shown in FIG. 3 is composed in FIG. 4, of a series circuit of a resistance $R_4$, a capacitor $C_{41}$ and a coil $L_{41}$, and a transistor $Tr_{41}$ having its base connected with the connecting point between the resistance $R_{41}$ and the capacitor $C_{41}$, and a coil $L_{42}$ forming a transformer together with the coil $L_{41}$, and that a by-pass tube $D_{41}$ is provided in parallel with the discharge tube 134 as a circuit to stop flashing of the discharge tube, also that coils $L_{43}$, $L_{44}$ forming a transformer and a capacitor $C_{42}$ being connected to the coil $L_{44}$ are provided as a circuit to trigger the by-pass tube $D_{41}$.

In operation FIG. 4 starts with conditions the same as those of FIG. 3 prior to the step of turning the switch 140 ON and charging each of the capacitors 128, 130, $C_{41}$, $C_{42}$ to prepare for flash. After that a synchronizing switch not shown in the drawing is turned ON in response to a shutter release and contacts a and s are short-circuited. The base potential of the transistor $Tr_{41}$ is lowered thereby turning the transistor $Tr_{41}$ ON raising gate potential of the thyristor 131 and turning on the thyristor 131. At the same time, the charge at the capacitor $C_{41}$ flows to the coil $L_{41}$ through the contacts a and s thereby generating an induced voltage at the coil $L_{42}$. The discharge tube 134 is now triggered for causing the a flash discharge tube to emit flash. Also as the thyristor 131 turns ON, the light sensing circuit functions as mentioned above and then the FET 113 generates a prescribed level of output and the switching circuit 116 is switched so as to turn on the transistor 117. The thyristor 138 also is turned on in exactly the same pattern as in the example shown in FIG. 3. As the thyristor 138 goes ON the charge of the capacitor $C_{42}$ is discharged through the thyristor 138 generating an induced voltage at the coil $L_{43}$ to trigger the by-pass tube $D_{41}$. As the by-pass tube $D_{41}$ is triggered ON, the charge of the main capacitor 128 is discharged through the by-pass tube and the flash of the discharge tube is stopped.

Figure 5:
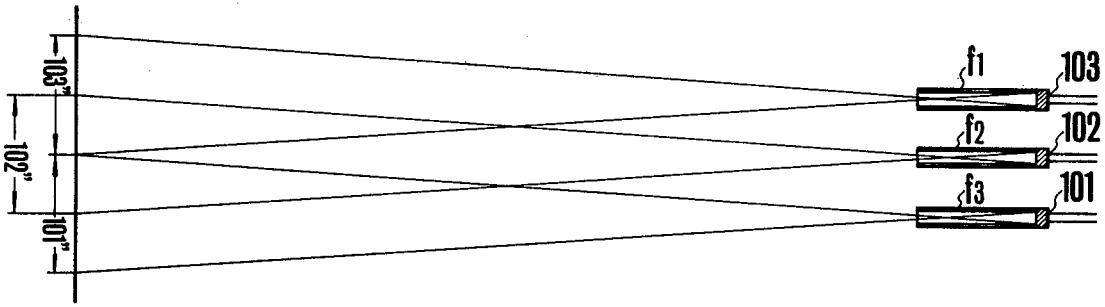
FIG. 5(*a*) is a set up diagram of a light sensing system when the light sensing circuits of the present invention are so provided that their light sensing zones are overlapped each other to secure higher possibility for obtaining proper exposure.
Figure 5:
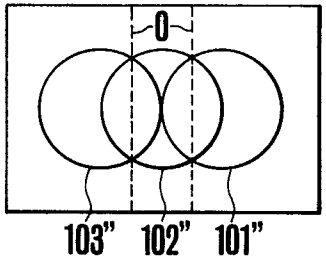
Figure 5:
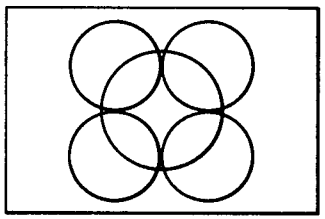
Figure 5:
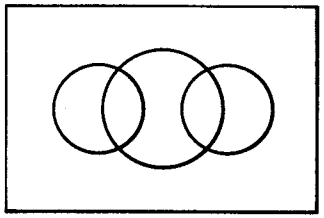
Figure 5:
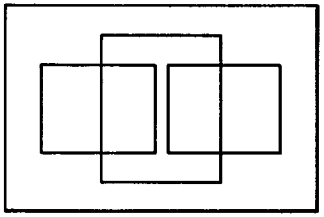

FIG. 5(*a*) is a diagram to show an example of a light sensing optical system in which light sensing is such that the light sensing zones by the light sensing circuits for a flash device according to the present invention overlap each other. Here light receiving elements 101 to 103 shown in FIG. 1, FIG. 3 and FIG. 4, have hoods $f_1$ to $f_3$ provided at the front planes of said light receiving elements 101 to 103. By providing hoods at the front planes of each of the light receiving elements as mentioned above, the angle of light received from a photographing field is limited and the light sensing zone of each light receiving element will become 101" to 103" as shown in FIG. 5(*b*) to have portions overlapped to each other. Here, since light receiving elements are shown in enlarged size in FIG. 5(*a*) against a photographing zone for the benefit of explanation, it seems as if there are portions not being overlapped depending on the distances to an object, but actually as the spacing among each light receiving element is sufficiently small the light sensing zone of each light receiving element will be overlapped zone as shown in FIG. 5(*b*) regardless of the distances. By sensing the light in thus overlapped zone, even in a case when an object or objects are located at a picture plane shown by the dotted line O in FIG. 5(*b*), proper exposure can be obtained. Also by changing the shape of the hoods various light sensing patterns as shown in FIG. 5(*c*) can be obtained. Also by providing filters with different transmission light volume at the front plane of each light receiving element or by differentiating the capacity of the capacitors 104 to 106 forming a time constant circuit, the light sensing against zones of photographing picture frame can be differentiated and the pattern of light sensing with concentration at the center area, etc. can be obtained selectively.

By employing a light sensing circuit for a flash device according to the present invention as mentioned above the light reflected from an object or objects all over a photographing field is received by a plurality of light receiving means having a respective light receiving scope and the flashing time is controlled by the output of the light receiving means having the largest amount of light received out of the light receiving means, therefore a proper exposure can be obtained always for an object or objects regardless of the position of the object or objects within the scope of photographing field, thus such advantageous effect can be realized in a light sensing circuit for a flash device as being able to freely determine the picture composition against an object or objects at the time of flash photographing.

What is claimed is:

1. A flash device comprising:

flash energy supply means for supplying flash energy;

flash means connected with said flash energy supply means to cause flash emission by the flash energy supplied from said flash energy supply means;

a plurality of light amount integrating circuits, each of said light amount integrating circuits having a light sensitive means, and producing an output corresponding to the amount of light incident upon each of said circuits;

said plurality of light amount integrating circuits including a first light amount integrating circuit which measures a middle photometric zone and second and third light amount integrating circuits which measure photometric zones on both sides of a picture being photographed, photometric zone regulating means optically connected with said light amount integrating circuit, for transmitting light flux emitted at said middle photometric zone toward said light sensitive means to a first light amount integrating circuit, and for transmitting a light flux emitted at said side photometric zones toward said light sensitive means to second and third light amount integrating circuits, each of the side photometric zones measured by the second and third integrating circuits being arranged to overlap the middle photometric zone measured by the first integrating circuit;

a trigger circuit for producing an output signal to trigger said flash means;

a constant voltage producing circuit which produces a constant voltage for a preset period of time in response to the output signal of said trigger circuit, an output terminal of said constant voltage producing circuit being connected to said plurality of light amount integrating circuits to impress a constant voltage on said integrating circuits;

flash stop signal generating means coupled to said integrating circuits and adapted to provide a flash stop signal in response to the output of the one of said plurality of integrating circuits which first reaches a predetermined value: and a control circuit connected with said flash means and said generating means and being adapted to stop emission of the flash of said flash means in response to said flash stopping signal.

2. A flash device according to claim 1, in which said flash stop signal generating means is connected with an output terminal of each of said integrating circuits through diodes.

3. A flash device according to claim 1, in which said light amount integrating circuit is constructed so as to increase its output corresponding to the reflected light to be sensed as time passes.

4. A flash device according to claim 1, in which each of said light amount integrating circuits has a different time constant to weight their effects.

5. A flash device according to claim 1, in which said photometric zone regulating means is constructed with a hood means arranged in front of each light sensitive means, and each of said hood means is adapted to regulate the photometric zone of each light sensitive means.

6. A flash device according to claim 1, in which respective discharge resistors are connected parallel each capacitor.

7. A flash device comprising:

flash energy supply means for supplying flash energy;

flash means connected to said flash energy supply means to cause flash emissions by the flash energy applied from said energy supply means;

a plurality of light sensitive elements, said elements containing a light sensitive element for measuring the light emitted from the photographing zone in the center part thereof and a light sensitive element for measuring the light emitted from the surroundings of said photographing zone including a photometric zone overlapping mutually on the photometric zone of said former light sensitive element;

said plurality of light amount integrating circuits including a first light amount integrating circuit which measures a middle photometric zone and second and third light amount integrating circuits which measure photometric zones on both sides of a picture being photographed, a photometric zone regulating means optically connected with said light amount integrating circuit, for transmitting a light flux emitted from said middle photometric zone to said light sensitive means in a first light amount integrating circuit, and for transmitting a light flux emitted from said side photometric zones to said light sensitive means in second and third light amount integrating circuits, each of the side photometric zones measured by the second and third integrating circuits being arranged to overlap the middle photometric zone measured by the first integrating circuit;

a trigger circuit for producing an output signal to trigger said flash means;

a constant voltage producing circuit for producing a constant voltage for a predetermined period of time in response to said output signal from said trigger circuit, said circuit including a capacitor connected in parallel with said main capacitor, a constant voltage element having its output terminal connected to said plurality of light amount integrating circuits, switching means connected between said capacitor and said constant voltage element, said switching means being energized in response to the output signal of said trigger circuit to form a discharge path for discharging the electric charge of said capacitor through said constant voltage element, whereby said constant voltage element being caused to produce a constant voltage for a preset period of time to impress it on said plurality of light amount integrating circuits;

flash stop signal generating means responsive to said integrating circuits to form a flash stop signal when the output of any of said integrating circuits reaches a predetermined value, and a control circuit for stopping the flash, said circuit being connected with said flash means and being adapted to stop flash emission of said flash means in response to said flash stopping signal emitted from said flash stop signal generating means.

8. A flash device comprising:

flash energy supply means for supplying flash energy;

flash means connected with said flash energy supply means to cause flash emission by the flash energy supplied from said flash energy supply means;

a plurality of light amount integrating circuits, each of said light amount integrating circuits having a light sensitive means and a capacitor, and producing an output corresponding to the amount of light incident upon each of said circuits;

said plurality of light amount integrating circuits including a first light amount integrating circuit which measures a middle photometric zone and second and third light amount integrating circuits which measure photometric zones on both sides of a picture being photographed, a photometric zone regulating means optically connected with said light amount integrating circuit, for transmitting a light flux emitted from said middle photometric zone to said light sensitive means in a first light amount integrating circuit, and for transmitting a light flux emitted from said side photometric zones to said light sensitive means in second and third light amount integrating circuits, each of the side photometric zones measured by the second and third integrating circuits being arranged to overlap the middle photometric zone measured by the first integrating circuit;

flash stop signal generating means coupled to said integrating circuits and adapted to provide a flash stop signal in response to the output of the one of said plurality of integrating circuits which first reaches a predetermined value; and a control circuit connected with said flash means and said generating means and being adapted to stop emission of the flash of said flash means in response to said flash stopping signal.

* * * * *